US007784553B2

(12) United States Patent
Moreno

(10) Patent No.: US 7,784,553 B2
(45) Date of Patent: Aug. 31, 2010

(54) DOWNHOLE WATERFLOOD REGULATOR

(75) Inventor: Jorge Moreno, Neuquen (AR)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/246,938

(22) Filed: Oct. 7, 2008

(65) Prior Publication Data

US 2010/0084139 A1 Apr. 8, 2010

(51) Int. Cl.
*E21B 34/14* (2006.01)

(52) U.S. Cl. ..... 166/386; 166/332.4; 166/332.5; 166/334.4

(58) Field of Classification Search ..... 166/374, 166/375, 386, 332.4, 332.5, 334.4
See application file for complete search history.

(56) References Cited

U.S. PATENT DOCUMENTS

| | | | | |
|---|---|---|---|---|
| 3,741,601 | A | 6/1973 | Dudley | |
| 4,035,103 | A | 7/1977 | McMurry et al. | |
| 4,110,057 | A | 8/1978 | McMurry et al. | |
| 4,128,106 | A | 12/1978 | Abercrombie | |
| 4,275,790 | A | 6/1981 | Abercrombie | |
| 4,633,954 | A | 1/1987 | Dixon et al. | |
| 5,042,584 | A | 8/1991 | Terral | |
| 5,070,902 | A | 12/1991 | Schraub | |
| 5,535,767 | A * | 7/1996 | Schnatzmeyer et al. | 137/1 |
| 5,706,891 | A | 1/1998 | Schraub | |
| 6,227,302 | B1 * | 5/2001 | Pringle et al. | 166/374 |
| 6,491,105 | B2 | 12/2002 | Holt, Jr. | |
| 7,228,909 | B2 | 6/2007 | Schmidt et al. | |

OTHER PUBLICATIONS

Baker Oil Tools; "Waterflood Flow Regulators;" Product Information Brochure; Jul. 2004.
"Weatherford Production: Water Injection Regulators;" Product Information Brochure located at http://www.weatherford.com/weatherford/idcplg?IdcService=GET_DYNAMIC_PAGE&PageName=index; © 2008 Weatherford International Ltd.
"Waterflood Flow Regulator;" Product Information Brochure; © Sep. 2003 Schlumberger; www.slb.com/oilfield.
"Conventional Waterflood Flow Regulator Valves;" Product Information Brochure; © Jul. 2003 Schlumberger; www.slb.com/oilfield.
"RF Series Production Pressure-Operated Valves;" Product Information Brochure; © 2008 Weatherford International Ltd.

(Continued)

*Primary Examiner*—Jennifer H Gay
*Assistant Examiner*—Elizabeth C Gottlieb
(74) *Attorney, Agent, or Firm*—Wong, Cabello, Lutsch, Rutherford & Brucculeri, LLP

(57) ABSTRACT

A downhole waterflood regulator installs in a side pocket mandrel to regulate fluid flow in a waterflood completion. The regulator has an internal piston and can have a check dart. The piston and check dart regulate fluid flow within the regulator's housing. Packings on the regulator's housing packoff the mandrel's ports that communicate with a surrounding annulus. When initially installed in the mandrel, a blanking plug on the regulator's latch prevents fluid flow through the regulator so that the regulator acts as a dummy valve and allows operators to set and test packers or perform other operations. To begin the waterflood operation, operators use a slickline to remove the blanking plug disposed in the latch. With the plug removed, fluid communicated from the tubing string can pass through the ported latch and into the regulator where the piston and check dart regulate the fluid flow out to the annulus.

30 Claims, 5 Drawing Sheets

OTHER PUBLICATIONS

"RD Series Dummy Valves;" Product Information Brochure © 2003 Weatherford International Ltd.

"SBRO-DVX Side-Pocket Gas-Lift Mandrel;" Product Information Brochure; © 2005-2007 Weatherford International Ltd.

"Wireline-Retrievable Latches for Sid-Pocket Mandrels;" Product Information Brochure; © 2005 Weatherford International Ltd.

"Side-Pocket Mandrels—Round-Body, Machined: SMOR and SMR Series;" Product Information Brochure; © 2005 Weatherford International Ltd.

"Side-Pocket Mandrels—Oval-Body, Forged and Machined: SF, SFO, SM and SMO Series;" Product Information Brochure; © 2006 Weatherford International Ltd.

"Wireline-Retrievable Chemical-Injection Valves: RCI Series;" Product Information Brochure; © 2006 Weatherford International Ltd.

"Weatherfor Artificial Lift Systems: Gas Lift Systems;" Product Information Brochure; © 2001 Weatherford International Ltd.

* cited by examiner

DOWNHOLE WATERFLOOD REGULATOR

BACKGROUND

Operators use waterflood regulators in side pocket mandrels to regulate what volume of injected fluid can enter a wellbore annulus. Ideally, the regulators control the injected fluid without producing significant pressure variations. A typical waterflood completion 10 illustrated in FIG. 1 has a wellhead 12 atop a casing 14 that passes through a formation. A tubing string 20 positioned in the casing 14 has a number of side pocket mandrels 60 positioned between packers 40. Surrounding the tubing string 20, these packers 40 separate the casing's annulus 16 into multiple isolated zones that can be separately treated.

To conduct a waterflood operation, operators install the waterflood regulators 70 by slickline into the side pocket mandrels 60. Shown in more detail in FIG. 2A, the mandrel 60 has a side pocket 64 in an offset bulge 62 on the mandrel 60. The pocket's upper end has a seating profile 65 for engaging a locking mechanism of the regulator (70) or other tool, while the pocket's other end 67 may be open. Ports 66 in the mandrel's pocket 64 communicate with the surrounding annulus (16) and allow for fluid communication during waterflood, gas lift, or other types of operations. The mandrel 60 may also have an orienting sleeve 61 for facilitating slickline operations and for properly aligning the regulator (70) within the pocket 64. During installation, a tool discriminator (not shown) can be used to guide the regulator (70) into the pocket 64 and deflects larger tools to prevent damage to the regulator (70).

With the completion 10 of FIG. 1 having the regulators 70 installed, operators can proceed with the waterflood operation by injecting fluid (e.g., water or the like) into the tubing string 20. The injected fluid passing down the tubing string 20 must first pass through the waterflood regulators 70 before it can pass into the annulus 16 through the mandrels' ports 66. Once in the annulus 16, the fluid can then pass through the casing's perforations 15 and interact with the surrounding formation.

In use, the installed regulators 70 allow fluid to flow from the tubing string 20 to the annulus 16 through the mandrels' ports 66 and restrict fluid flow in the reverse direction. In other words, the regulators 70 act as one-way valves and regulate the volume of water that can pass from the tubing string 20 to the annulus 16. Each of the regulators 70 operate independently of one another and separately control the volume of fluid that can enter the adjacent isolated zone. In this way, each of the regulators 70 can compensate for differential pressure changes in each zone and can provide a constant volume of fluid for each zone.

In a new waterflood completion, operators typically first set the packers 40 and test their pressure containment before performing the waterflood operation. Because the mandrels 60 have side ports 66 and the regulators 70 control fluid flow into the annulus 16, operators first install dummy valves in each of the mandrels 60 to isolate flow between the tubing string 20 and the casing annulus 16. For example, FIG. 2B shows a dummy valve 30 installed in the mandrel's pocket 64 using a slickline (not shown) and latch 34. When installed, the dummy valve 30 does not actually operate as a valve. Instead, the dummy valve 30 has a closed or solid body, and packings 32 on the outside of the dummy valve 30 straddle and pack off the ports 66 to the annulus 16 to prevent fluid flow into the annulus 16. Once the dummy valves 30 have been installed in the mandrels 60 of the completion 10 as in FIG. 1, operators can hydraulically set the packers 40 and can also test that the packers 40 are correctly set and do not leak by pumping fluid down the tubing string 20 without having the fluid pass to the annulus 16. In this way, the dummy valve 30 facilitates setting and testing of the packers 40.

After setting and/or testing the packers 40, operators must then retrieve the dummy valves 30 from the mandrels 60 using slickline operations. Then, as shown in FIG. 2C, operators install the waterflood regulators 70 into the mandrel's side pockets 64 with additional slickline operations. One typical example for the waterflood regulator 70 is the RWF-2R series regulator available from Weatherford/Lamb, Inc.—the Assignee of the present disclosure. These regulators 70 also have a latch 74 and have packings 72 that straddle and packoff the mandrel's ports 66.

In use, fluid in the mandrel 60 can pass into a ported nose 78 on the regulator 70. Entering the nose 78, the fluid flow can route up the center of the regulator 70 and can exit ports 76 in the regulator's side to communicate through the mandrel's ports 66. Internally, the regulator 70 has a reverse flow check valve (not shown) to regulate the flow inside the regulator 70 and to prevent back flow from the annulus 16 into the tubing string 20.

Unfortunately, the process of first installing and then retrieving the dummy valves 30 as in FIG. 2B and then installing the regulators 70 as in FIG. 2C takes a considerable amount of time to perform, especially when the well has multiple isolated zones. In addition, the multiple installations and retrievals increase the risk of losing tools in the wellbore, which can be detrimental to operations.

In some completions, operators install special dummy valves (referred to as equalizing dummy valves) that allow operators to equalize pressures between the tubing string 20 and the annulus 16 once testing has been completed. With these dummy valves, operators run a slickline down the tubing string 20 to remove a prong on the dummy valve while it is still installed in the mandrel 60. With the prong removed, operators can circulate fluid freely through the dummy valve so that the valve essentially operates as a circulator to equalize the casing and tubing pressures. Even with these equalizing dummy valves, however, operators must still perform additional slickline operations to perform a waterflood operation by pulling the equalizing valves from the mandrel 60 and subsequently installing the regulators 70 in the mandrels 60.

What is needed is a way to simplify the installation process of a waterflood completion and to reduce the risk of losing tools in the wellbore in the process.

DETAILED DESCRIPTION

A downhole waterflood regulator installs in a side pocket mandrel to regulate fluid flow in a waterflood completion. The regulator has a flow regulating mechanism that uses an internal piston and a check dart to regulate fluid flow through the regulator's housing. Packings on the side of the regulator's housing packoff side or bottom ports in the mandrel that communicate with a surrounding annulus. When initially installed in the mandrel, a blanking plug on the regulator's latch prevents fluid flow through the regulator so that the blanked regulator can operate as a dummy valve. The blanked regulator allows operators to set and test packers or perform other operations without having fluid pass through the mandrels' ports to the surrounding annuls. To begin the waterflood operation, operators use a slickline to remove the blanking plug disposed in the latch. With the plug removed, fluid can communicate from the tubing string, through the ported latch, and into the regulator where the piston and check dart regulate the fluid flow out to the annulus through ports in the regulator and ports in the mandrel.

Figure 3A:
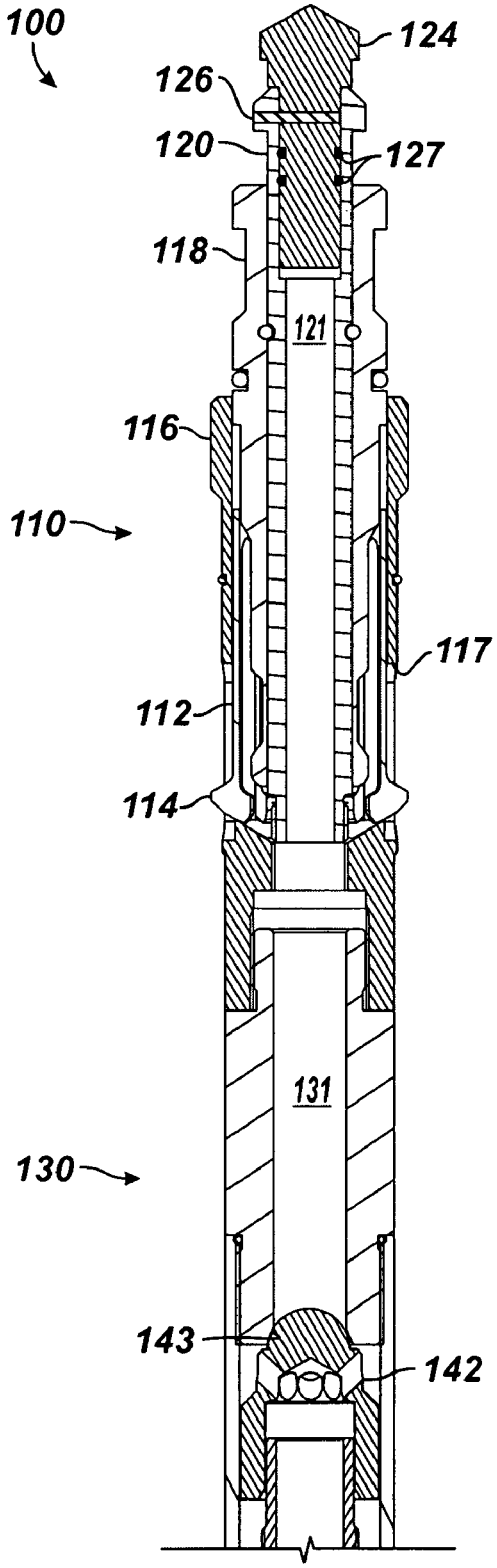
FIGS. 3A-3B illustrate a waterflood regulator according to the present disclosure.
Figure 3B:
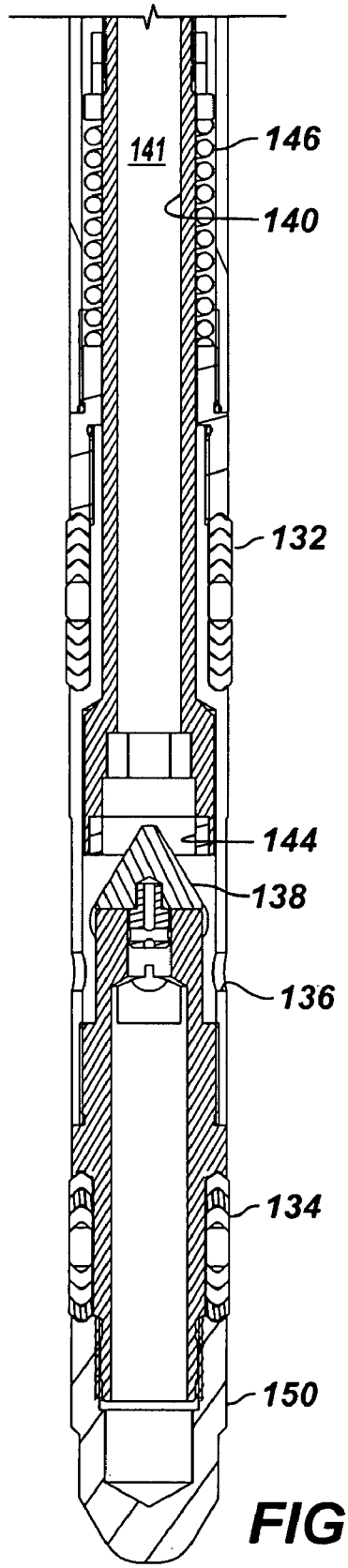

Turning to the drawings, a waterflood regulator 100 illustrated in FIGS. 3A-3B has a housing 130 with a latch 110 on its uphole end and with a nose 150 on its downhole end. Packings 132 and 134 straddle the outside of the housing 130 above and below side ports 136 and packoff these ports 136 when the regulator 100 is installed in a side pocket mandrel as discussed below.

Internally, the regulator 100 has a flow regulating mechanism movably disposed in the housing's flow passage 131 that regulates fluid flow through the regulator 100. The flow regulating mechanism includes a regulator piston 140, a check dart 142, a seating ring 144, and a conical seat 138. The regulator piston 140 positions inside the housing's bore 131 and has a central flow passage 141. The check dart 142 positions in the flow passage 131 at the piston's upper end, and a seat ring 144 surrounds the inside of the piston's flow passage 141 at the its lower end. The seat ring 144 is movable relative to the conical seat 138 also positioned in the flow passage 131 adjacent the housing's side ports 136.

To regulate fluid flow, fluid communicated into the housing's flow passage 131 acts against the check dart 142. Moved under pressure, the check dart 142 moves on the piston's upper end relative to an upper seat 143 in the housing's flow passage 131. When the dart 142 unseats, orifices in the dart 142 allow fluid to pass through the dart 142 and into the piston's flow passage 141 to eventually pass through the housing's side ports 136.

Continued fluid applied to the dart 142 will move the piston 140 downward in the flow passage 131 against the bias of a spring 146. As the piston 140 shifts, the seat ring 144 moves closer to the lower conical seat 138 in the housing's flow passage 131 to restrict fluid flow. This conical seat 138 is allowed to float on its pin connection to the housing 130 to prevent misalignment with the seat ring 144 when the two are closely metering flow.

Eventually, if fluid pressure becomes too great, the fluid pressure overcomes the full bias of the spring 146 and pushes the piston 140 downward so that the seat ring 144 engages the conical seat 138 and closes off fluid communication through the regulator 100. Similarly, if back pressure in the surrounding annulus becomes too great, the pressure acting against the bottom of the check dart 142 causes the dart 142 to engage the upper seat 143 and to close off any back flow through the regulator 100. The spring's bias can then eventually return the piston 140 to its upper position.

Figure 1:
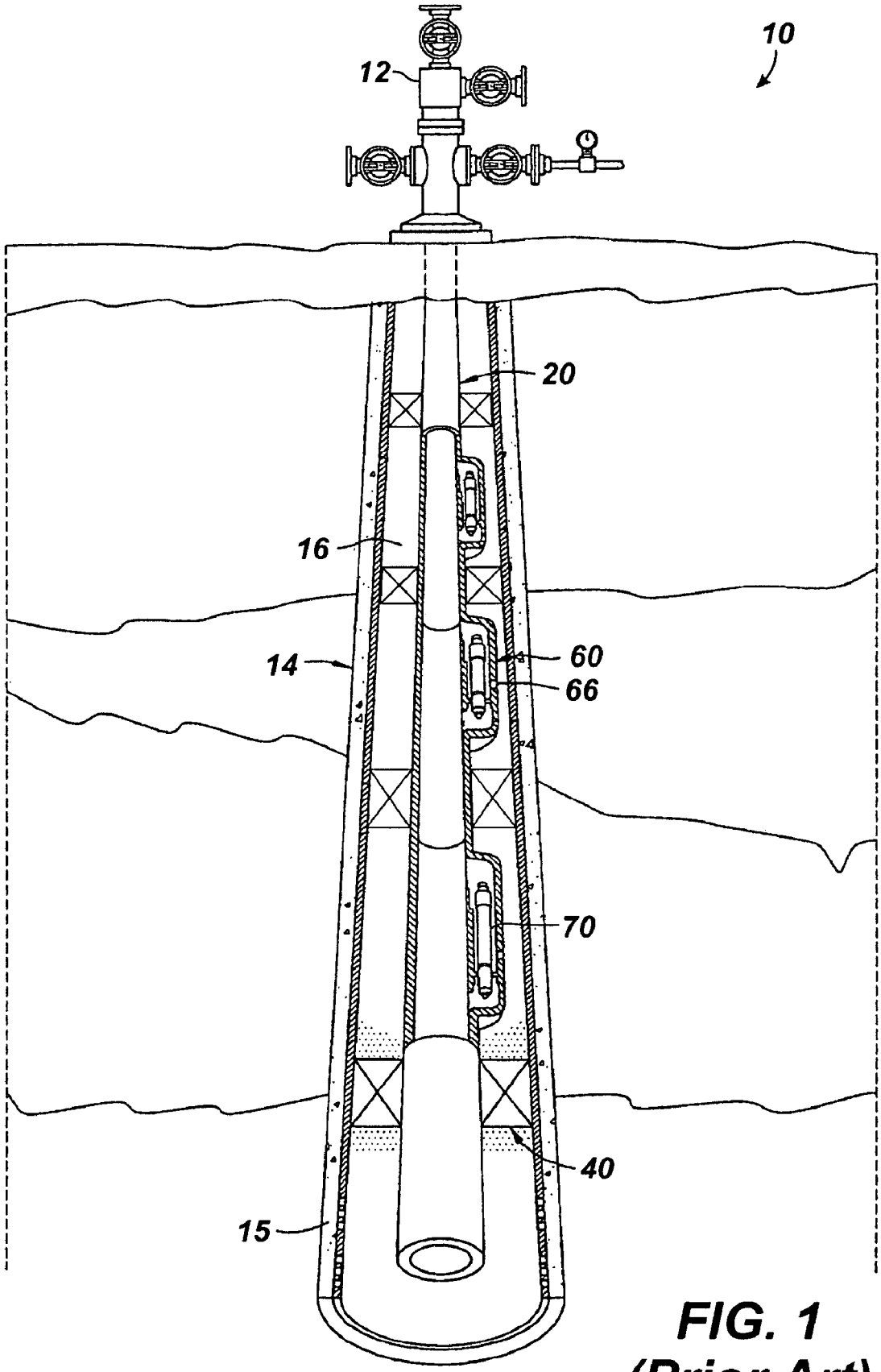
FIG. 1 (Prior Art)
FIG. 1 illustrates a typical waterflood completion.
Figure 2A:
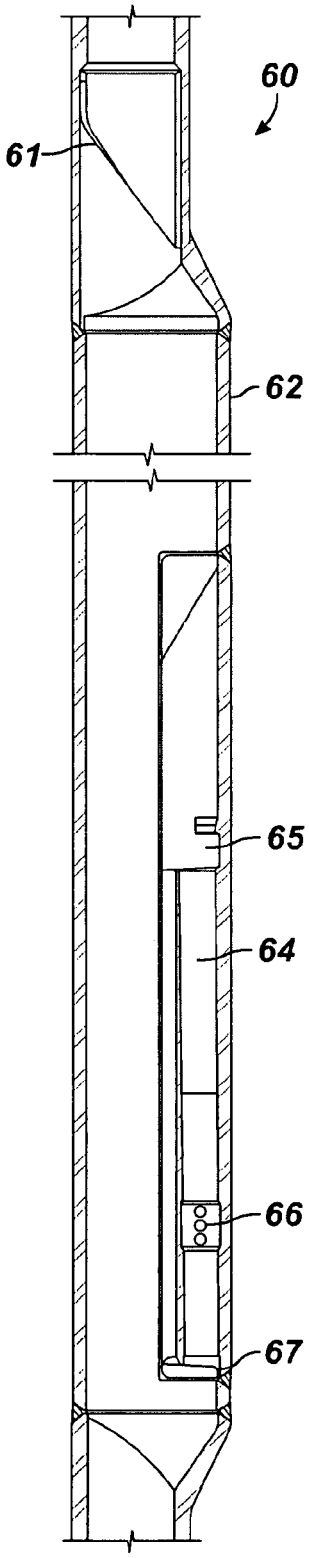
FIG. 2A (Prior Art)
FIG. 2A illustrates a side pocket mandrel.
Figure 2B:
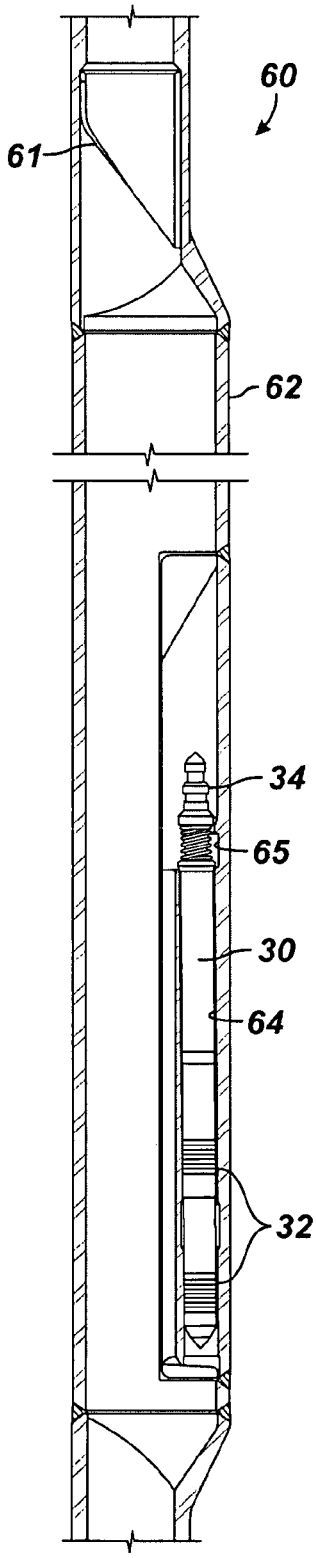
FIG. 2B (Prior Art)
FIG. 2B illustrates a dummy valve positioned in the side pocket mandrel.
Figure 2C:
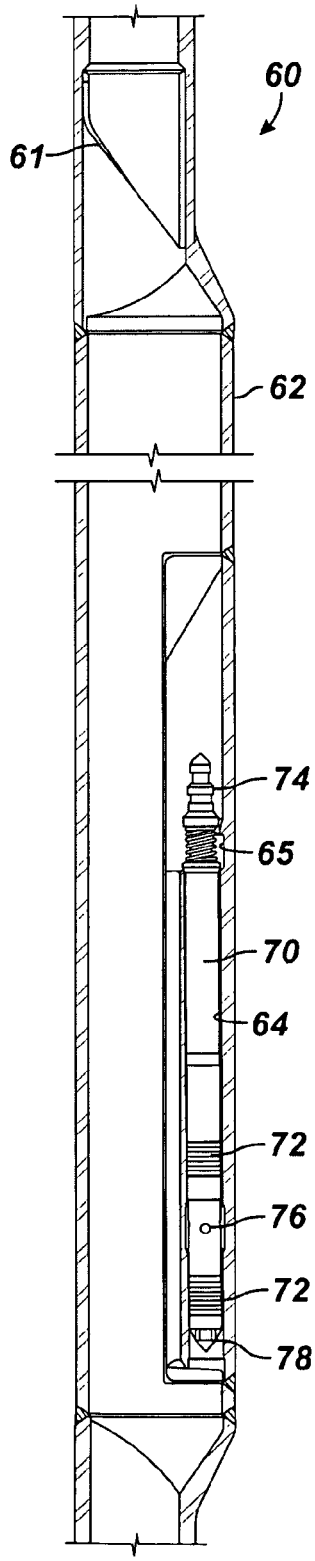
FIG. 2C (Prior Art)
FIG. 2C illustrates a conventional waterflood regulator positioned in the side pocket mandrel.

The latch 110 attached to the housing 130 is used to install and retrieve the regulator 100 in a side pocket mandrel. The latch 110 is a collet-type locking mechanism similar to a MT-2 style latch used for installing slickline retrievable regulators in side pocket mandrels. The latch 110 can lock in a 360-degree latch-pocket profile of a mandrel (See e.g., profile 65 in FIG. 2A).

For this collet-type arrangement, the latch 110 has a collet 112, a latch housing 116, a latch sleeve 118, and a central core 120. The collet 112 is movably positioned on the sleeve 118, and the sleeve 118 is movably positioned on the central core 120. The central core 120 affixes inside the latch housing 116, and the latch housing 116 affixes to the regulator's housing 130.

Biased latch lugs 114 on the collet 112 can move within slots 117 in the latch housing 116. Manipulation of the latch sleeve 118 changes its position along the central core 120 and either permits or restricts the extension or bending of the biased lugs 114 in the slots 117. Depending on the orientation of the core's profile and the collet 112, the lugs 114 can catch on an appropriate latch-pocket profile (65) of a side pocket mandrel (60) (See e.g., FIG. 2A) to hold the regulator 100 in place.

With an understanding of how the regulator 100 can install in a mandrel and regulate fluid flow, discussion now turns to how the regulator can operate as a dummy valve and as a regulator in a waterflood completion. On the latch 110, a blanking plug 124 fits in the central core's flow passage 121, and a shear pin 126 and O-ring seals 127 can temporarily hold the blanking plug 124 in place, although other forms of temporary connection could be used. While held in place, the blanking plug 124 prevents fluid outside the regulator 120 from passing into the passage 121 and subsequently into the regulator's housing 130 and out the side ports 136. In this blanked condition, the regulator 100 can operate as a dummy valve in the waterflood completion. When the blanking plug 124 is removed, however, fluid is allowed to pass through the regulator 100, and the regulator 100 can operate as a waterflood regulator in the completion.

Figure 4A:
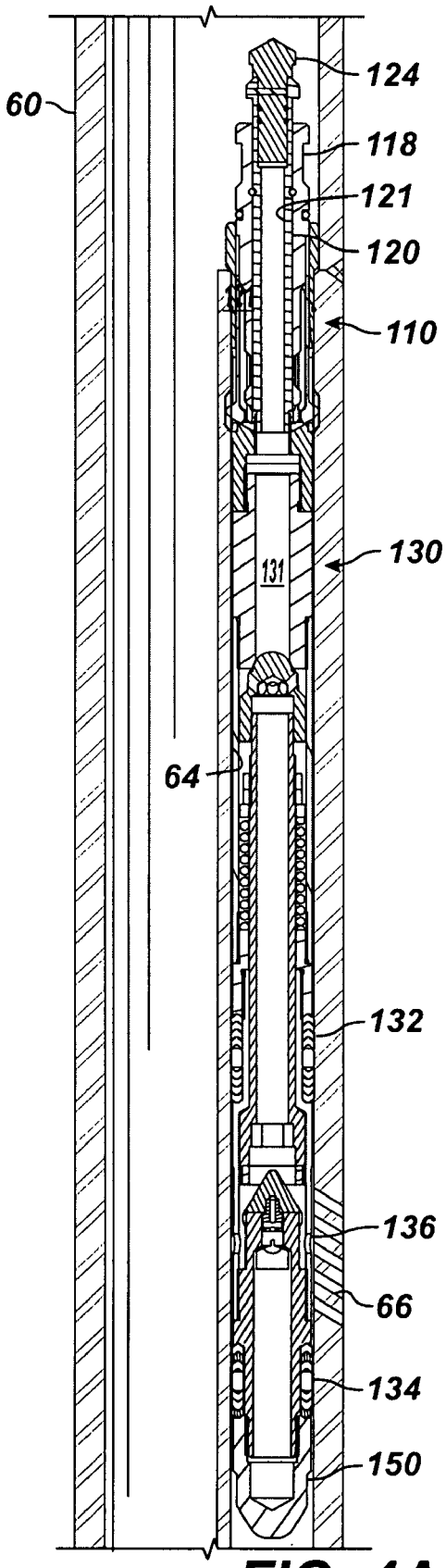
FIG. 4A illustrates the waterflood regulator positioned in a side pocket mandrel and operating as a dummy valve.

In FIG. 4A, for example, the waterflood regulator 100 is shown positioned in a side pocket 64 of a mandrel 60. A suitable mandrel includes a McMurry-Macco® side pocket mandrel, such as the SM-2 or SFO-2 series available from Weatherford/Lamb, Inc. If the mandrel 60 is already installed downhole, a slickline operation and appropriate tool (not shown) can be used to run the regulator 100 downhole the tubing string and install it in the side pocket 64 so the mandrel's packings 132 and 134 straddle and packoff the mandrel's ports 66. Alternatively, the regulator 100 can be installed manually in the mandrel 60 during initial installation at the surface so that the mandrel 60 with installed regulator 100 can be run downhole together without the need for a slickline operation to install the regulator 100.

As shown, the regulator 100 has a blanked condition with the blanking plug 124 installed in the regulator's latch 110. In this blanked condition, the regulator 100 can essentially operate as a dummy valve and can allow operators to pump fluid, test seals, and perform other operations without the fluid passing through the regulator 100 and escaping through the mandrel's ports 66 to a surrounding annulus.

Figure 4B:
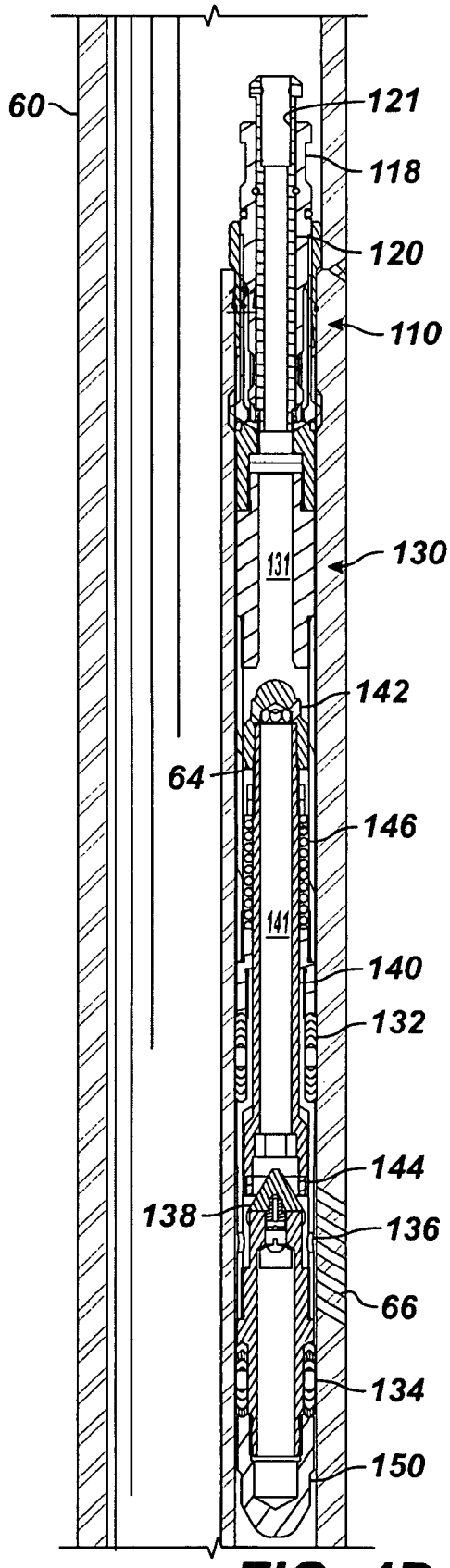
FIG. 4B illustrates the waterflood regulator positioned in the side pocket mandrel and operating to regulate fluid flow.

Once operators have completed any needed operations while the removable blanking plug 124 is in place, operators use a slickline operation to remove the blanking plug 124 so that the regulator 100 has an unblanked condition and is ready for use as a waterflood regulator. As shown in FIG. 4B, for example, operators have removed the blanking plug 124 by pulling on the plug 124 and breaking the shear pin 126 using a slickline operation and appropriate tool. With the plug 124 removed, the waterflood regulator 100 can operate as described previously to regulate fluid flow from the tubing string to the surrounding annulus and to maintain a preset flow rate regardless of pressure changes in the injection stream or formation zone.

As discussed previously, for example, flow can enter the top of the regulator 100 through the ported latch 110 so that fluid in the mandrel 60 can pass into the central core's flow passage 121 and into the housing 130. The fluid acts against the check dart 142 causing it to unseat from seat 143. When the dart 142 unseats, fluid can flow through restrictive ports or orifices in the dart 142, through the hollow piston 140, past the seat ring 144 and cone seat 138, and out the side ports 136. The piston 140 can also be forced against the bias of the spring 146, and the seat ring 144 can engage the conical seat 138. Again, the regulator 100 can prevent back flow as discussed previously.

The ability to install the regulator 100 in a blanked condition as in FIG. 4A so that various operations can be performed and then to convert it to an unblanked condition for waterflood operations using a slickline as in FIG. 4B eliminates the need to first install a dummy valve in the mandrel 60 and then make additional runs by slickline to remove the dummy valve and install the regulator, as is currently performed in the art. To eventually retrieve the regulator 100, slickline procedures and an appropriate tool (not shown) manipulate the latch 110's collet-style locking mechanism to disengage the latch 110 from the mandrel's pocket profile 64 so the regulator 100 can be removed from the mandrel 60.

Figure 5:
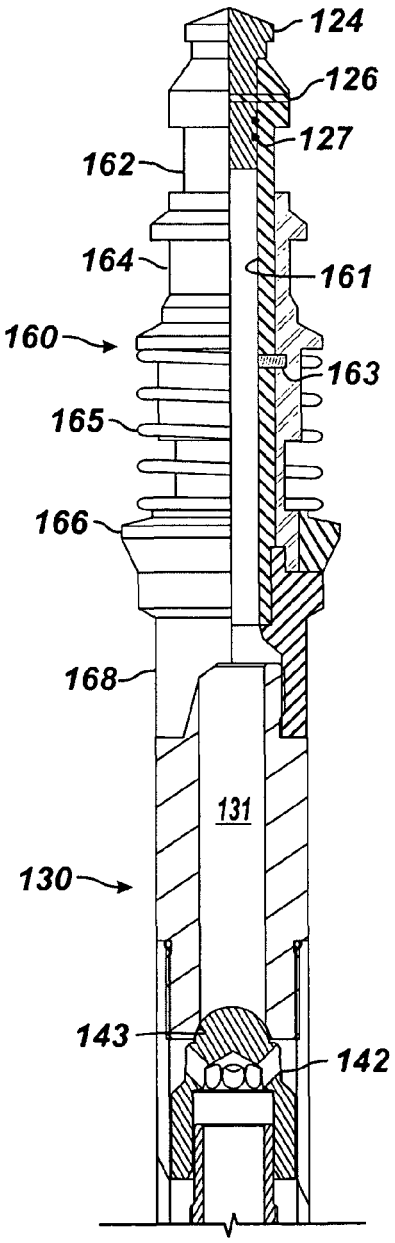
FIG. 5 illustrates a top of the waterflood regulator having a ring-style latch.

Although the regulator 100 as discussed above has a collet-type latch 110, the regulator 100 can use other types of latches. For example, FIG. 5 shows a top of the regulator's housing 130 with an alternate latch 160 positioned thereon. This latch 160 has ring-style locking mechanism with a central core 162 attached to a coupling member 168 that in turn is connected to the regulator's housing 130. A sleeve 164 movable on the core 162 is biased by a spring 165. The sleeve 164's lower end can move relative to a ring 166 allowing the ring 166 to engage or disengage from a complementary lock profile of a side pocket mandrel. A shear pin 163 initially holds the sleeve 164 in position on the central core 162. For blanking the regulator, the plug 124 disposes in an internal passage 161 of the central core 162 and uses a shear pin 126 and O-rings 127 as a temporary connection.

Although the regulator 100 as discussed above has a separately movable check dart 142, this is not strictly necessary. Instead, the uphole end of the piton 140 can incorporate features of the check dart 142. In this way, the piston's uphole end can have restrictive ports and can be configured to seat against the upper seat 143 in the housing's flow passage 131. To regulate fluid flow, fluid communicated into the housing's flow passage 131 can act against the piston's uphole end to move the piston's upper end away from the upper seat 143 and move the piston 140 against the bias of the spring 146. When the end unseats, the restrictive ports in the piston's end can allow fluid to pass into the piston's flow passage 141 to eventually pass through the housing's side ports 136. Similarly, reverse flow through the piston's passage 141 can move the piston 140 so that its uphole end seats against upper seat 143 with the help of the spring 146's bias.

Figure 6A:
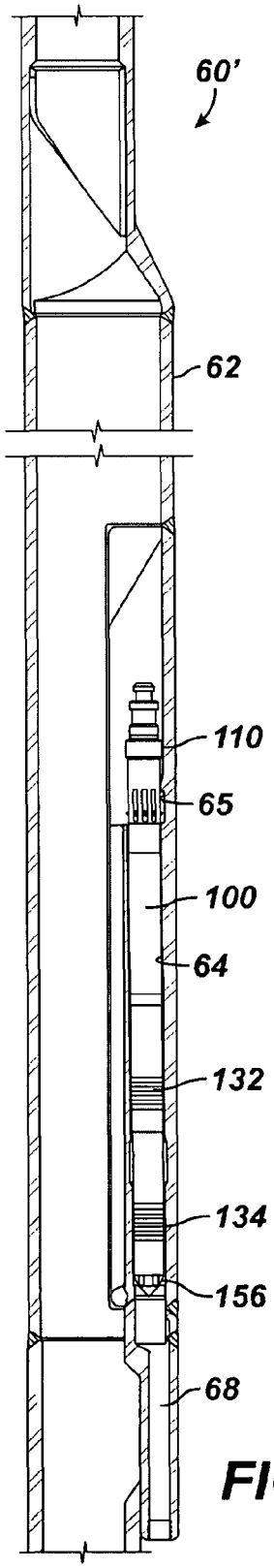
FIG. 6A illustrates another side pocket mandrel usable with a waterflood regulator of the present disclosure.

Although the mandrel 60 discussed previously has side ports 66 and the regulator 100 discussed above also has side ports 136, other arrangements could also be used. As shown in FIG. 6A, for example, a mandrel 60' has a bottom port 68 disposed at the bottom of the pocket 64. This bottom port 68 allows fluid flow from the pocket 64 to flow down the side of the mandrel 60' and the tubing string (not shown). A suitable example of such a mandrel is the SFO-2WF type of mandrel from Weatherford/Lamb, Inc.

Figure 6B:
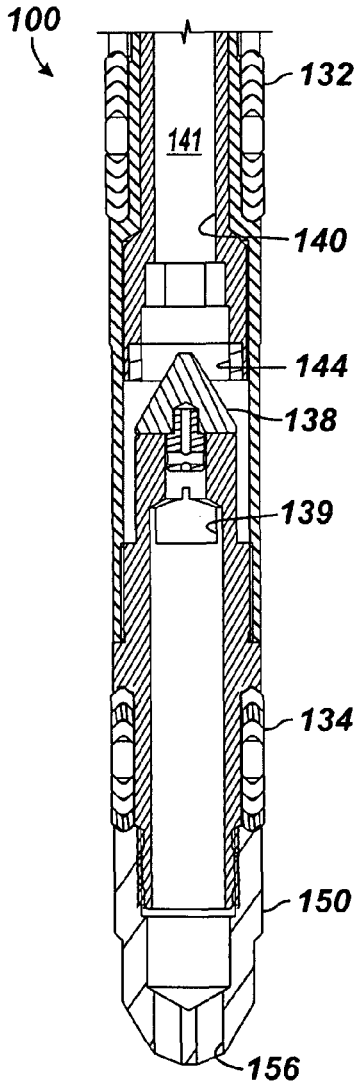
FIG. 6B illustrates a bottom portion of a waterflood regulator usable with the mandrel of FIG. 6A.

For use with such a mandrel 60', the regulator 100 partially shown in FIG. 6B can have bottom ports 156 (as opposed to side ports 136 as in FIG. 3B). When fluid is allowed to pass through the regulator 100, the bottom ports 156 in the nose 150 allow the fluid to exit the bottom of the regulator 100 and communicate through the mandrel's bottom port (68; FIG. 6A) to the annulus. The portion of the regulator's housing that supports the conical seat 138 can have slots 139 allowing the fluid flow that passes the seat 138 to reach the bottom ports 156 in the nose 150.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole waterflood regulator, comprising:

a housing;

a flow mechanism movably disposed in the housing and regulating fluid flow therethrough;

a latch disposed on the housing and being engageable with a lock profile of a side pocket mandrel; and a plug removably disposable on the latch, the plug being disposed on the latch preventing fluid communication through the housing, the plug being removed from the latch permitting fluid communication through the housing.

2. The regulator of claim 1, wherein the flow mechanism comprises:

a piston movably disposed in a first internal passage of the housing, the piston having first and second ends and a second internal passage therethrough, the first end engageable with a first seat disposed in the first internal passage to control fluid communication between the second internal passage and one or more ports communicating outside the housing.

3. The regulator of claim 2, wherein the first seat comprises a conical seat movably disposed in the first internal passage.

4. The regulator of claim 2, wherein the second end of the piston has at least one flow orifice, the second end being engageable with a second seat disposed in the first internal passage to control fluid communication between the first and second internal passages.

5. The regulator of claim 2, wherein the flow mechanism comprises:

a check dart movably disposed in the first internal passage adjacent the second end of the piston and having at least one flow orifice, the check dart being engageable with a second seat disposed in the first internal passage to control fluid communication between the first and second internal passages.

6. The regulator of claim 5, wherein the at least one flow orifice in the check dart comprises a plurality of restrictive ports.

7. The regulator of claim 5, wherein a biasing element biases the piston towards the second seat.

8. The regulator of claim 1, wherein a temporary connection holds the plug in the latch.

9. The regulator of claim 8, wherein the temporary connection comprises a shear pin affixing the plug in an internal passage of the latch.

10. The regulator of claim 9, wherein the temporary connection comprises seals engaged between the plug and the internal passage.

11. The regulator of claim 1, wherein the latch comprises:

a rod having an internal passage communicating with the housing, the plug removably disposed in the internal passage;

a sleeve movably disposed on the rod and having an outer profile; and a collet movably disposed on the sleeve, the collet having biased locks selectively engageable with the lock profile of the mandrel and the outer profile of the sleeve.

12. A waterflood completion system, comprising:

a mandrel disposed on a tubing string deployable down a borehole, the mandrel having a side pocket and a lock profile, the side pocket having one or more first ports for communicating the tubing string with an annulus of the borehole; and a regulator disposable within the side pocket of the mandrel and adapted to regulate fluid flow between the mandrel and the annulus, the regulator at least including— a latch disposed on the regulator and engageable with the lock profile of the mandrel, and a plug removably disposable on the latch, the plug being disposed on the latch preventing fluid communication through the regulator, the plug being removed from the latch permitting fluid communication through the regulator.

13. The system of claim 12, wherein the regulator comprises:

a first seat disposed in a first internal passage of the regulator adjacent one or more second ports communicating outside the regulator; and a piston movably disposed in the first internal passage, the piston having first and second ends and a second internal passage therethrough, the first end engageable with the first seat to control fluid communication between the second internal passage and the one or more second ports.

14. The system of claim 13, wherein the first seat comprises a conical seat movably disposed in the first internal passage.

15. The system of claim 13, wherein the regulator comprises a second seat disposed in the first internal passage, and wherein the second end of the piston has at least one flow orifice, the second end being engageable with the second seat to control fluid communication between the first and second internal passages.

16. The system of claim 13, wherein the regulator comprises:

a second seat disposed in the first internal passage; and a check dart movably disposed in the first internal passage adjacent the second end of the piston, the check dart having at least one flow orifice and being engageable with the second seat to control fluid communication between the first and second internal passages.

17. The system of claim 16, wherein a biasing element biases the piston towards the second seat.

18. The system of claim 12, wherein a temporary connection holds the plug in an internal passage of the latch.

19. The system of claim 18, wherein the temporary connection comprises a shear pin affixing the plug in the internal passage.

20. The system of claim 19, wherein the temporary connection comprises a seal engaged between the plug and the internal passage.

21. The system of claim 12, wherein the latch comprises:

a rod having an internal passage communicating with the regulator, the plug removably disposed in the internal passage;

a sleeve movably disposed on the rod and having an outer profile;

a collet movably disposed on the sleeve, the collet having biased locks selectively engageable with the lock profile of the mandrel and the outer profile of the sleeve.

22. A waterflood completion method, comprising:

running a tubing string having a side pocket mandrel in a borehole;

installing a waterflood regulator in the side pocket mandrel, the waterflood regulator having a blanked condition preventing fluid communication through the regulator;

opening the waterflood regulator by converting the waterflood regulator to an unblanked condition; and wherein opening the waterflood regulator comprises removing a blanking plug with a slickline tool, the blanking plug removably disposed in a latch on the regulator.

23. The method of claim 22, wherein installing the waterflood regulator comprises:

running the waterflood regulator in the tubing string; and seating the waterflood regulator in the side pocket mandrel.

24. The method of claim 23, wherein running the waterflood regulator in the tubing string comprises using a slickline.

25. The method of claim 22, wherein installing the waterflood regulator comprises:

seating the waterflood regulator in the side pocket mandrel; and running the waterflood regulator seated in the side pocket mandrel in the borehole with the tubing string.

26. The method of claim 22, wherein installing the waterflood regulator in the side pocket mandrel comprises engaging the latch on the regulator in a lock profile in the mandrel.

27. The method of claim 22, wherein opening the waterflood regulator comprises removing a blanking plug removably disposed on the regulator with a slickline tool.

28. The method of claim 22, wherein before opening the waterflood regulator, the method comprises pumping fluid down the tubing string and preventing fluid communication to the annulus with the regulator in the blanked condition.

29. The method of claim 28, wherein pumping fluid down the tubing string comprises hydraulically setting a packer on the tubing string with the pumped fluid.

30. The method of claim 28, wherein pumping fluid down the tubing string comprises testing a set packer on the tubing string with the pumped fluid.

* * * * *